US005384623A

United States Patent [19]

Ohashi et al.

[11] Patent Number: 5,384,623

[45] Date of Patent: Jan. 24, 1995

[54] PROCESS CONTROL STABILIZING SYSTEM INCLUDING A CLEANING DEVICE FOR THE CORONA WIRES

[75] Inventors: Kunio Ohashi, Nara; Hiroshi Kinashi, Tsuzuki; Mitsuru Tokuyama, Nara, all of Japan

[73] Assignee: Sharp Kabushiki Kaisha, Osaka, Japan

[21] Appl. No.: 7,769

[22] Filed: Jan. 22, 1993

[30] Foreign Application Priority Data

Jan. 23, 1992 [JP] Japan ..... 4-009890

[51] Int. Cl.[6] ..... G03G 21/00

[52] U.S. Cl. ..... 355/207; 355/221

[58] Field of Search ..... 355/203, 204, 205, 206, 355/208, 215, 222; 361/225; 250/324

[56] References Cited

U.S. PATENT DOCUMENTS

| | | | |
|---|---|---|---|
| 3,870,883 | 3/1975 | Oagley | 250/324 |
| 4,680,669 | 7/1987 | Tsuchiya et al. | 361/230 |
| 4,924,268 | 5/1990 | Ogura | 355/221 X |
| 5,012,093 | 4/1991 | Shimizu | 250/324 |
| 5,194,897 | 3/1993 | Yoshiyama et al. | 355/221 X |

FOREIGN PATENT DOCUMENTS

| | | |
|---|---|---|
| 1-102579 | 4/1989 | Japan . |
| 1-261676 | 10/1989 | Japan . |

OTHER PUBLICATIONS

Japanese Patent Application Laid-open No. Hei 2-179659.

Japanese Patent Application Laid-open No. Hei 3-105360.

Japanese Patent Publication No. Sho 61-29502.

Japanese Utility Model Application Laid-open No. Hei 2-123947.

Japanese Utility Model Application Laid-open No. Hei 3-20349.

*Primary Examiner*—A. T. Grimley

*Assistant Examiner*—Nestor R. Ramirez

*Attorney, Agent, or Firm*—David G. Conlin; Kevin J. Fournier

[57] ABSTRACT

The present invention provides a process control stabilizing system including a cleaning device for the corona wires which allows the process control to be carried out optimally based on exact information which is obtained by certain sensors while a discharge from the main charger unit is kept uniform. The system is constructed so that an electrode cleaner is activated before the detection of the surface potential and/or the detection of the optical density, and in addition, the cleaning operation will be operated until the detection result falls within a predetermined range. Alternatively, the system causes detection of the surface potential and/or detection of the optical both before and after a cleaning operation by the electrode cleaner. The cleaning operation will be repeated until the difference between the first and second detections falls within a predetermined range. In the above operations, if the repetitions of the operations in excess of the predetermined number of times cannot make the detection result fall within the predetermined range, the system preferably activates a warning device and/or prohibits a copying operation.

4 Claims, 12 Drawing Sheets

PROCESS CONTROL STABILIZING SYSTEM INCLUDING A CLEANING DEVICE FOR THE CORONA WIRES

BACKGROUND OF THE INVENTION (1) Field of the Invention

The present invention relates to a process control stabilizing system which is incorporated in an image forming apparatus and controls the electrophotographic process so as to provide an image in an optimum condition.

(2) Description of the Related Art

Generally, with regard to photoconductive members for use in image forming apparatuses, the surface potential of a photoconductive member varies largely dependent upon environmental conditions of the location where it is used. As regards OPC's (organic photoconductors), for example, the surface potential at low temperature environment is lower by 100 to 150 V than that at a normal temperature due to dependance of the mobility of photocarriers therein. With regard to Se-photoconductors, the amount of thermally excited carriers varies dependent upon temperatures, so that the potential increases by 50 v at a low temperature and decreases by 50 to 100 volts at an elevated temperature. The temperature dependence is problematic. Further, the OPC's exhibit a tendency that the thickness of the photosensitive layer thereof is reduced by mechanical stresses (that is, scratching or abrasive effects by a cleaner blade and/or copy paper) with the total copy volume increased. The variations of the surface potential in a photoconductive member due to the aforesaid effects, would lower the density of an image copied or bring about other great deterioration to image quality. Further the variations would influence the toner consumption amount for development to give rise to a waste of toner. On the other hand, as to developers, the amount of frictionally generated static electric charges of toner varies depending on environment charges. Specifically, under a circumstance at a low temperature with low humidity, toner tends to acquire more charges resulting in lowering in image density (i.e. the halftone density lies within approximately $0.8\pm0.4$), while toner powders get less charges at an elevated temperature with a high humidity, to induce increase of the image density, deterioration of gradation reproduction behavior, and/or a waste of toner etc.

Moreover, even if the copying mode were changed, the effect would sometimes fail to reflect due to the disadvantages stated above. That is, the image quality between different modes would not be clear or distinguishable, or the intention to lessen the toner consumption could not be achieved. In order to eliminate these defects and drawbacks, there are disclosed various proposals of process controls one of which is cited as Japanese Patent Publication Sho 61 No. 29502. A method of the publication includes the steps of measuring electric charges in both dark and light portions and then controlling the condition for charging based on the measurement in the dark portion while controlling the condition for exposure or development with reference to the measurement in the light portion, in order to provide exactly controlled images.

Another method includes the steps of detecting a surface potential of a photoconductive member at proper times by surface potential meter provided inside copier and adjusting optimally based on the detected quantity the power of charger and/or the applied voltage for exposure lamp. Still another method includes the steps of exposing an image of a referential white board etc. onto a photoconductive member, developing the latent image into a visual image with toner, measuring the density of the toner-image by an optical sensor, and optimally adjusting based on the detected quantity the power of charger, the toner density of developer, the bias voltage for development, and the power voltage for exposure lamp.

With the conventional arrangement described above, however, it has been impossible to get proper information on images from sensors due to a lack of uniformity in discharging by a charger. The charger is at all times exposed to and polluted with toner powders splashing inside the copier, an evaporated and splashed silicon oil used in heat-fixing process, and/or any other dirt outside the copier. This makes it very difficult to keep discharge of the charger uniform across the longitudinal direction of a photoconductive member. For this reason, unevenness in discharging occurs and this causes the photoconductive member to have an uneven distribution of its surface potential in the longitudinal direction thereof, or the toner-developed image on the photoconductive member for the referential white board to become uneven. If a surface potential meter or optical sensor samples the portion with such unevenness, the resultant measurement cannot represent a cross-section or typical value of the entire system, and the process of the system might disadvantageously be controlled based upon the erroneous measurement. This failure to control the process may possibly bring about various serious problems. That is, a process condition widely deviates from an optimally controlled condition might cause fluctuation of the quality of images. A defectively controlled process condition might damage the photoconductive member. Alternatively, an unusual increase in toner density fails to provide balanced frictional electrification charges to toner powders, yielding weakly charged toner which would make images foggy. Moreover, augment of toner might cause the toner powders to splash, polluting the inside of the copier.

To overcome these problems, that is, to measure against the uneven distribution of static electric charges on the photoconductive member, various proposals have been made. For example, Japanese Patent Application Laid-Open Hei 2 No. 179659 discloses a corona charging device in an electro-copier able to detect the unevenness of charges and automatically executing cleaning operation of a corona charger when the charger causes uneven discharge. The device detects irregularity of toner density of the image on a photoconductor as an indicator for unevenness of discharging by the corona charger. More specifically, if a toner density sensor incorporated in the device exhibits an output power lower than a threshold level, the device recognizes occurrence of the unevenness in discharging. Based upon the detection, cleaning means is activated which comprises cleaning pads sandwiching the charging wires stretched in the charger and being slidable so as to be driven by a stepping motor. Thus, on the occasion of detecting uneven toner density, the stepping motor is activated to execute cleaning operation.

Like the above disclosure, Japanese Utility Model Application Laid-Open Hei 3 No. 20349, relating to an image forming apparatus equipped with an automatic cleaning mechanism in a corona charger, measures the density of a referential image on its photoconductive member by using detecting means comprising plural photosensors, and executes cleaning operation in the same manner as described of the above prior art by moving and sliding the cleaning mechanism when difference between the density values detected by the different photosensors is found to exceed a predetermined level.

Another Japanese Utility Model Application Laid-Open Hei 2 No. 123947 proposes a technology relates to an image recording apparatus comprising a plurality of developing units, wherein charging wires in the charger are cleaned by a cleaning means every time a different developing unit is selected. Here the cleaning means used is of slidable type with the same structure described above. The object of this apparatus is to conduct cleaning operation of the charging wires in accordance with the selection of the developers.

Of these three publications, the first and second articles disclose the apparatuses all of which execute cleaning operation of the charging wires in the charger based on the comparison of the output power of the toner density sensor or sensors with a predetermined value. In consequence, it is true that the charging wires are cleaned effectively, but it is not that the process is controlled exactly based upon the density change, so that these cannot be thought of as the most suitable process control methods.

The third article discloses a technology in which the charging wires in the charger are cleaned before a currently engaged developing unit is replaced by a different unit in order to change the developing process. Therefore, this method is not the one that keeps on controlling a certain developing unit with reference to its output information.

On the other hand, Japanese Patent Application Laid-Open Hei 3 No. 105360 discloses an image forming apparatus capable of performing automatic maintenance including cleaning operation of charger in parallel with the operations for attaching and detaching an IC card as a portable external memory means. Cleaning means disposed slidably with sandwiching corresponding electrodes is provided for each of a primary charger, a transfer charger and a separation charger, and is adapted to be driven by a respective motor supplied by a motor driving power source. The activation of these motors, in consequence the cleaning operation, is determined by a counter for total copy number. Here, the connector of the aforesaid IC card serves as a detecting means, being connected detachably to the apparatus body.

The method is to control automatically certain subjects for maintaining the image forming apparatus using the IC card. Nevertheless, in this method, the wires of the chargers will not be cleaned until the detecting means sends out the order i.e, the signal for cleaning. In other words, the method is not the one that carries out an exact process control following the information from the photoconductive member.

SUMMARY OF THE INVENTION

It is therefore an object of the present invention to provide a process control stabilizing system which allows the precess control to be carried out optimally based on exact information which is obtained by certain sensors with assuredly keeping uniform a discharge from the main charger unit.

In order to achieve the above object, the present invention is constructed as follows.

That is, in accordance with one aspect of the present invention, a process control stabilizing system for use in an image forming apparatus in which a visual image is formed by the steps of electrifying the surface of a photoconductive member by discharging electricity from a discharging electrode of a charger, exposing the photoconductive member to light corresponding to a pattern image to form an electrostatic latent image, and developing the latent image with toner, the system which allows process control means to control the electrophotographic process on the basis of the surface potential of the photoconductive member detected by potential detecting means, to thereby obtain an optimum image, is characterized in that the charger is provided with electrode cleaning means for cleaning the discharging electrode, and the process control means controls and activates the electrode cleaning means to clean the discharging electrode of the charger prior to detection of the surface potential of the photoconductive member by the potential detecting means.

In accordance with another aspect of the invention, a process control stabilizing system for use in an image forming apparatus in which a visual image is formed by the steps of electrifying the surface of a photoconductive member by discharging electricity from a discharging electrode of a charger, exposing the photoconductive member to light corresponding to a pattern image to form an electrostatic latent image, and developing the latent image with toner, the system which process control means to control the electrophotographic process on the basis of the optical toner density of a toner image detected by density detecting means, to thereby obtain an optimum image, is characterized in that the charger is provided with electrode cleaning means for cleaning the discharging electrode, and the process control means controls and activates the electrode cleaning means to clean the discharging electrode of the charger prior to detection of the optical density by the density detecting means.

In accordance with a further aspect of the invention, a process control stabilizing system for use in an image forming apparatus in which a visual image is formed by the steps of electrifying the surface of a photoconductive member by discharging electricity from a discharging electrode of a charger, exposing the photoconductive member to light corresponding to a pattern image to form an electrostatic latent image, and developing the latent image with toner, the system which comprises at least one or both of potential detecting means for detecting the surface potential of the photoconductive member and density detecting means for detecting the optical density of a toner image, and allows process control means to control the electrophotographic process on the basis of the detection result to thereby obtain an optimum image, characterized in that the charger is provided with electrode cleaning means for cleaning the discharging electrode; and the process control means controls and activates the electrode cleaning means to clean the discharging electrode of the charger if the detection result from the potential detecting means and/or the density detecting means falls out of a predetermined range, performs again the detection to obtain detection result from the potential detecting means and/or the density detecting means, and repeats the series of controlling operations until the detection result falls within the predetermined range.

In the above case, in a case where the operation of the electrode cleaning means based on the detection result from the potential detecting means and/or density detecting means has been repeated up to a predetermined number of times in the aforementioned process control means, if the detection result after the predetermined times of detections does not fall within the predetermined range, it is effective that the system activates warning means and/or prohibits copying operation.

In accordance with still another aspect of the invention, a process control stabilizing system for use in an image forming apparatus in which a visual image is formed by the steps of electrifying the surface of a photoconductive member by discharging electricity from a discharging electrode of a charger, exposing the photoconductive member to light corresponding to a pattern image to form an electrostatic latent image, and developing the latent image with toner, the system which comprises at least one or both of potential detecting means for detecting the surface potential of the photoconductive member and density detecting means for detecting the optical density of a toner image, and allows process control means to control the electrophotographic process on the basis of the detection result to thereby obtain an optimum image, characterized in that the charger is provided with electrode cleaning means for cleaning the discharging electrode; and the process control means controls and activates the electrode cleaning means to clean the discharging electrode of the charger after the detection step in which the surface potential is detected by the potential detecting means and/or the optical density is detected by the density detecting means, thereafter performs again the detection to obtain detection result from the potential detecting means and/or the density detecting means, takes a difference of the detection result between before and after the cleaning of the discharging electrode, and repeats the series of controlling operations until the difference of the detection result falls within a predetermined range.

In the above case, in a case where the operation of the electrode cleaning means based on the difference of the detection result from the potential detecting means and/or density detecting means has been repeated up to a predetermined number of times in the aforementioned process control means, if the difference of the detection result after the predetermined times of the detections does not fall within the predetermined range, it is effective that the system activates warning means and/or prohibits copying operation.

Since the present invention is constructed as stated above, it is possible to perform detection of the surface potential by the potential detecting means and/or detection of the optical density by the density detecting means while a discharge from the main charger unit is assured to be uniform. In addition, the controlling operation can be repeated until the difference between the detections before and after the cleaning of the electrode falls within a predetermined range. In the above operations, if an abnormal state occurs, the system is adapted to activate warning means and/or prohibit copying operation, thus making it possible to effect an optimum process control on the basis of the exact information.

DESCRIPTION OF THE PREFERRED EMBODIMENTS

One embodiment of the present invention will hereinafter be described with reference to FIGS. 1 to 11. This embodiment will be illustrated in a case where a process control stabilizing system is applied to a copying machine.

Figure 1:
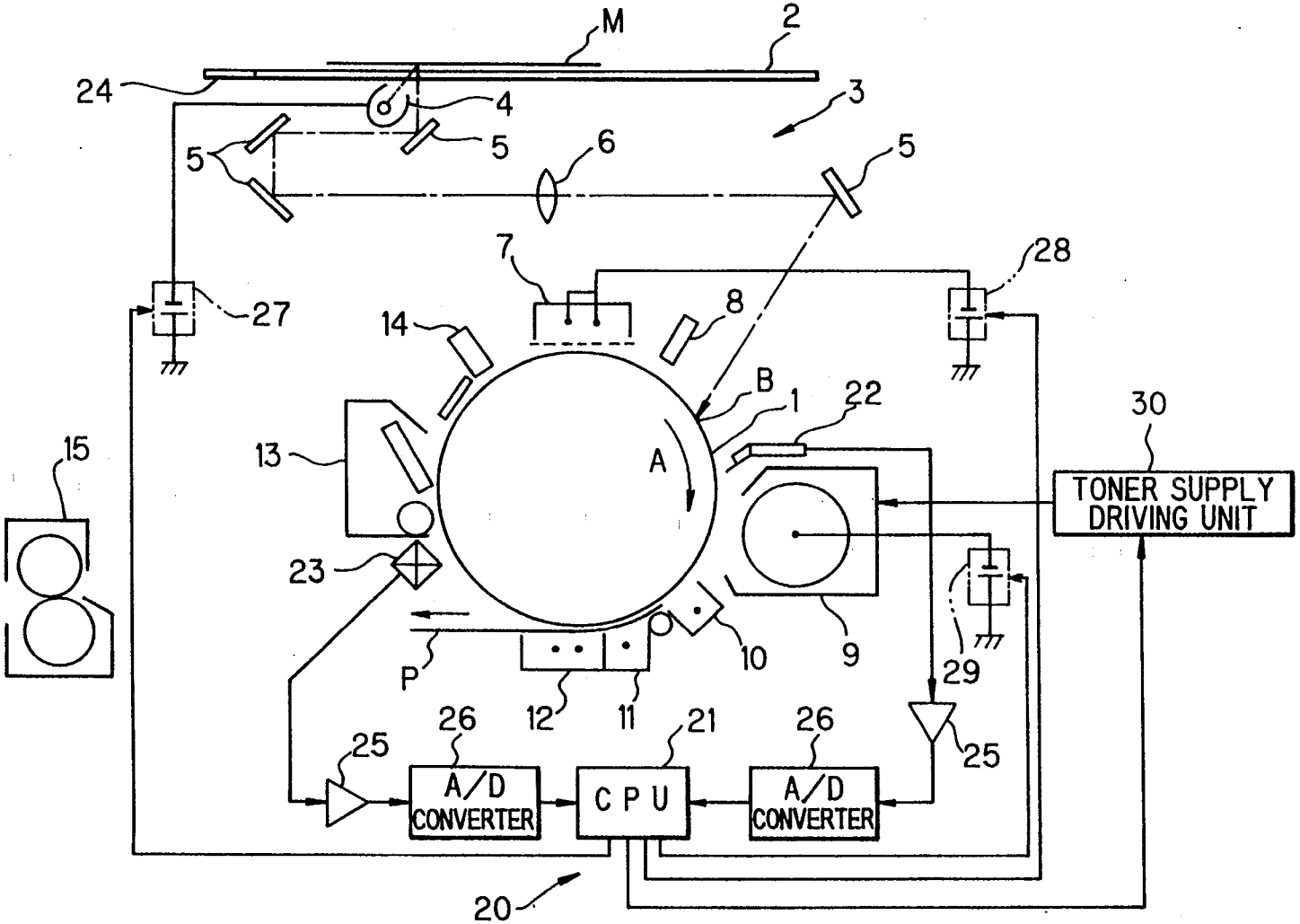
FIG. 1 is a block diagram showing a copying machine to which one embodiment of the invention is applied.

The copying machine to which the embodiment is applied comprises, as show in FIG. 1, a cylindrical photoconductive drum 1 rotatable in a direction of arrow A in the apparatus. The photoconductive drum 1 is structured with a drum substrate of, for example, an aluminum prime tube with the wall thickness of 2 mm, 100 mm in diameter, and 340 mm in length. Typically, an electric carrier generating layer of 1 μm thick and an electric carrier transporting layer of 34 μm thick are coated on the outside circumferential surface of the drum substrate uniformly successively in that order to form an organic semiconductor material. Disposed above the photoconductor drum 1 is a transparent original setting table 2 on which an original M is put. Disposed between the original setting table 2 and the photoconductive drum 1 is an exposure optical system 3 comprising an exposure lamp 4, a plurality of mirrors 5 and a lens 6.

In the exposure optical system 3, light emitted from the exposure lamp 4 optically scans the original M on the original setting table 2, and the reflected light is focused to irradiate at an exposure point B the surface of the photoconductive drum 1 through mirrors 5 and lens 6 as shown with a chain line in FIG. 1. The surface of the photoconductive drum 1 having been electrified uniformly by a main charger unit 7 which will be referred to hereinafter is thus exposed to form an electrostatic latent image thereon in accordance with the pattern image of the original M.

Disposed around the photoconductive drum 1 are the main charger unit 7 as stated above for charging or electrifying the surface of the photoconductive drum 1 at a predetermined voltage; a blank lamp 8 for erasing charges from the non-image area on the surface of the photoconductive drum 1; a developing unit 9 for developing with a toner the electrostatic latent image into a toner-developed image; an advance charge-removing lamp 10 for removing residual charges from the surface of the photoconductive drum 1 before transferring the toner-image; a transfer charger 11 for transferring the toner-image formed on the surface of the photoconductive drum 1 to a sheet of paper P to be transferred; a separation charger 12 for separating the copy paper P having the toner-image thereon from the surface of the photoconductive drum 1; a cleaner unit 13 for collecting residual toner on the surface of the photoconductive drum 1; a charge removing lamp 14 for removing residual electric charges on the surface of the photoconductive drum 1. The copy paper P separated from the photoconductive drum 1 with the help of the separation charger 12 is conveyed through an unillustrated moving path to a fixing unit 15 disposed on paper-discharging side. The fixing unit 15 fixes the toner image on the copy paper.

According to this embodiment, the copier is equipped with a process control stabilizing system 20 which comprises a CPU (central processing unit) 21 as process controlling means for optimally regulating the voltage applied to the exposure lamp 4, the output power of the main charger unit 7, the developing bias voltage for developing unit 9 and the toner density of a developer; a surface potential sensor 22 as potential detecting means for detecting the surface potential of the photoconductive drum 1 and controlling the CPU 21 based on the detection result; and an optical sensor 23 as density detecting means for detecting the optical density of a referential toner image formed on the surface of the photoconductive drum 1 and controlling the CPU 21 based on the detection result. The referential toner image is created by scanning a referential white board 24 disposed at an end of the original setting table 2 with light emitted from the exposure lamp 4 so as to form an electrostatic latent image upon the surface of the photoconductive drum 1, and developing the latent image into a toner-image by the developing unit 9.

Figure 2:
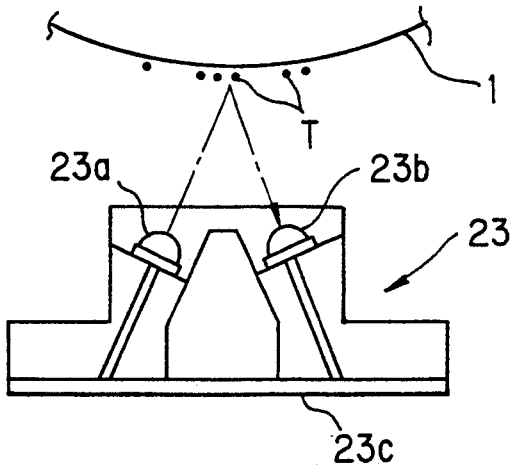
FIG. 2 is an illustration showing a manner in which optical density is detected by an optical sensor as a part of the copying machine shown in FIG. 1.
Figure 3:
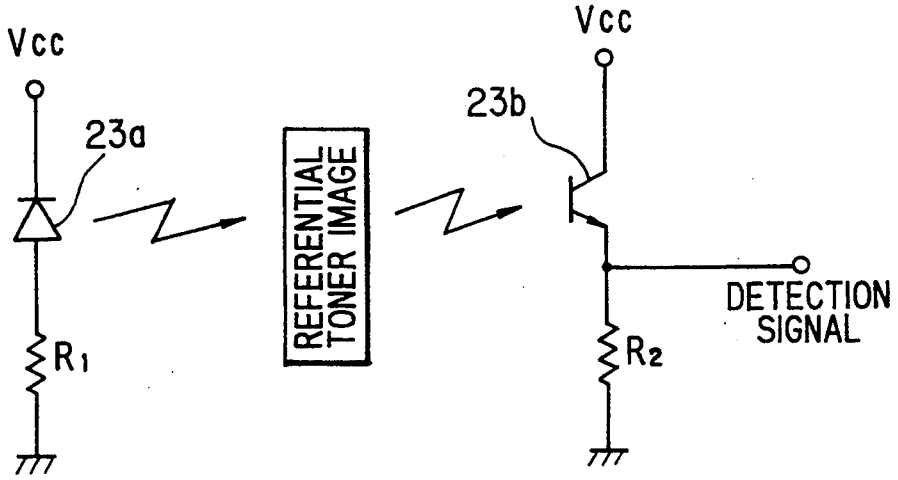
FIG. 3 is a schematic circuit diagram showing the optical sensor in FIG. 2.
Figure 4:
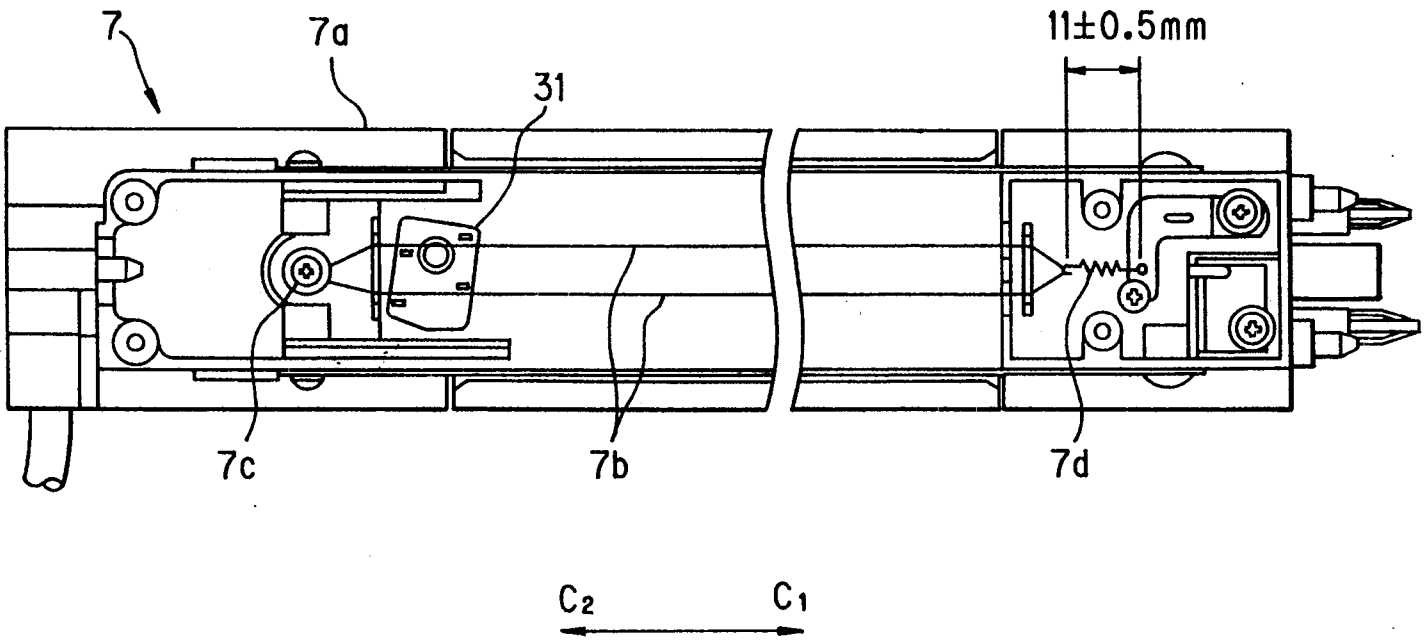
FIG. 4 is a plan view showing a main charger unit as a part of the copying machine shown in FIG. 1.

The surface potential sensor 22 is used of an oscillating sector type, and disposed in the periphery of the photoconductive drum 1 on the upstream side of the developing unit 9. The optical sensor 23 comprises, as shown in FIG. 2, an 890 nm-infrared LED (light emitting diode) 23*a*, a phototransistor 23*b* and holder 23*c* for supporting the both, and is disposed in the periphery of the photoconductive drum 1 on the upstream of the cleaner unit 13. As shown in FIG. 3, the LED 23*a* is connected at its cathode to a power voltage Vcc and grounded at its anode through a resistance $R_1$ to form a light emitting section. On the other hand, the phototransistor 23*b* is connected at its collector to a power voltage Vcc and grounded at its emitter through a resistance $R_2$ to form a light receiving section. An output terminal for extracting the detection signal is taken out from a joint between the emitter of the phototransistor 23*b* and the resistance $R_2$.

The optical sensor 23 senses the optical density of a referential toner image T formed on the surface of the photoconductive drum 1 such that the LED 23*a* of the light emitting section emits light onto the referential toner image T, and the light reflected therefrom is picked up and detected by the phototransistor 23*b* of the light receiving section. The optical sensor 23 outputs the thus sensed optical density as a detection signal. The surface potential sensor 22 detects the surface potential of the photoconductive drum 1 and outputs the detected value as a detection signal in the same manner as does the optical sensor 23.

The above sensors 22, 23 are connected at their respective output terminals to the same CPU 21 through individual amplifiers 25, 25 and individual A/D converters 26, 26. The output terminals of the CPU 21 are connected to the main charger unit 7 through a power source 28, the developing unit 9 through a developing bias source 29 and the developing unit 9 through a toner supply driving unit 30.

Meanwhile, the main charger unit 7, which electrifies the surface of the photoconductive drum 1 at a predetermined voltage as already described, comprises an elongated rectangular supporting member 7*a* and two parallel discharging wires 7*b*, 7*b* (discharging electrode) stretched in the longitudinal direction of the supporting member 7*a*. The discharging wires 7*b*, are made of a tungsten wire of 70 μm in diameter. The wires 7*b*, are fixed at their one ends with a screw 7*c* to the supporting member 7*a*, while the other ends are attached to the supporting member 7*a* via a spring 7*d* so that the tension of the wires is adjustable.

Figure 5:
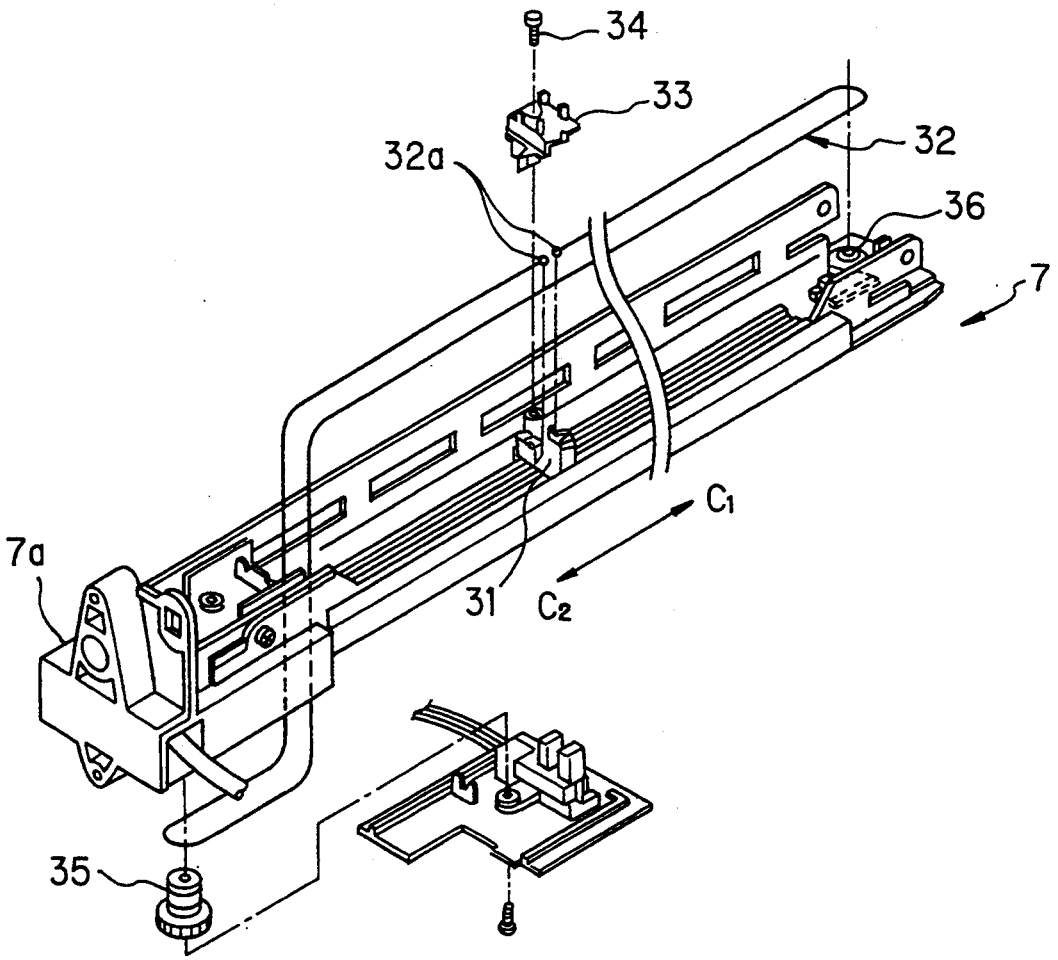
FIG. 5 is an exploded perspective view showing electrode cleaning means provided for the same main charger unit shown in FIG. 4.
Figure 6:
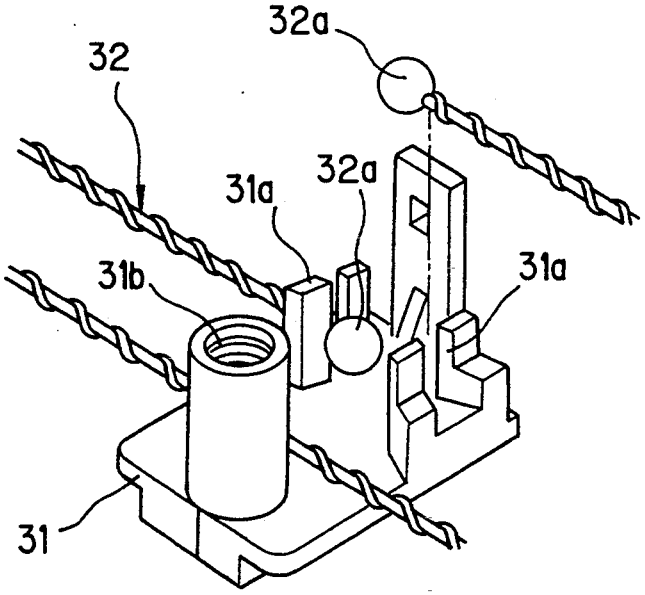
FIG. 6 is a perspective view showing a manner in which a wire for driving is attached to a frictionally slidable member as a part of the electrode cleaning means shown in FIG. 5.
Figure 7:
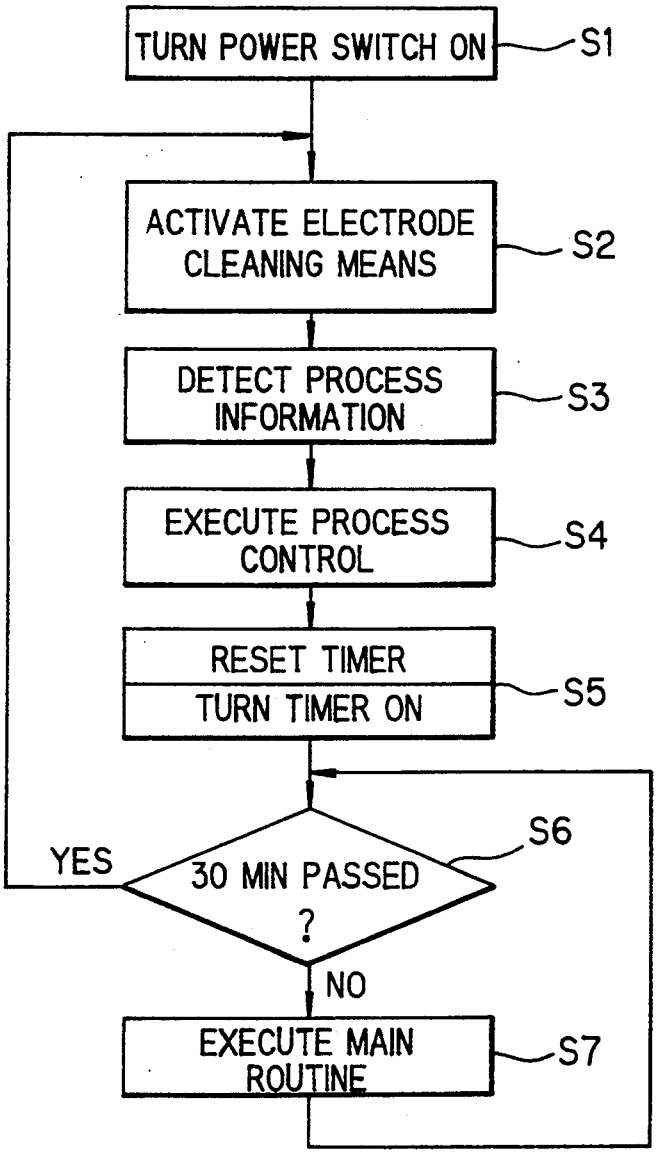
FIG. 7 is a flowchart illustrating operations for controlling the copying process executed by a CPU in a process control stabilizing system as part of the copying machine shown in FIG. 1.

The main charger unit 7 is provided with electrode cleaning means for cleaning the discharging wires 7*b*, 7*b*. The cleaning means includes a frictionally slidable piece 31 for slidably wiping the discharging wires 7*b*. As is shown in FIGS. 5 and 6, the frictionally slidable piece 31 is fixedly attached to a driving wire 32 such that the engaging ends 32*a*, 32*a* are each accepted by respective catching members 31*a*, 31*a* and the engaging portion is covered with a holder 33 which is fixed by a screw 34 fitting in an internal thread 31*b*. The driving wire 32 with the frictionally slidable piece 31 is wound around driving and idler pulleys 35 and 36 disposed at both extremities in the longitudinal direction of the supporting member 7*a*. In this arrangement, the driving pulley 35 is rotated by an unillustrated motor, to cause the frictionally slidable piece 31 to move back and forth in a direction of $C_1$–$C_2$ across which the discharging wires 7*b* are extended, whereby the discharging wires 7*b*, 7*b* are wiped and cleaned. The driving motor as a driver for the frictionally slidable piece 31 is driven by the control of the CPU 21 before the detection performed by the above-mentioned sensors 22 and 23.

In the configurations described above, referring to a flowchart of FIG. 7, description will be made hereinafter about the control of electrophotographic process achieved by the CPU 21 in the process control stabilizing system 20 of this embodiment.

First of all, when the power switch of the copy machine is tuned on (S1), the CPU 21 controls the driving motor so as to move the frictionally slidable piece 31 back and forth three rounds in the direction $C_1$–$C_2$, thus wiping and cleaning the discharging wires *7b* in the main charger unit 7 (S2).

Next, the surface potential sensor 22 detects the surface potential of the photoconductive drum 1, while the optical sensor 23 detects the optical density of the reference toner image formed on the surface of the photoconductive drum 1. The thus detected signals are inputted to the CPU 21 through the respective amplifiers 25, 25 and the respective A/D converters 26, 26 (S3).

Based on the detection signals from the sensors 22 and 23, the CPU 21 sends out output signals to the power sources 27, 28, 29 and the toner supply driving unit 30, so as control optimally the voltage to the exposure lamp 4, the power of the main charger unit 7, the development bias voltage in the developing unit 9 and the toner density of the developer (S4).

Then, a timer (not shown) in the system is reset or initialized and then turned on (S5). At a next step (S6), judgment is made on whether thirty minutes has elapsed after the timer was turned on. At S6, if the lapse of time is less than thirty minutes, the main routine is executed (S7), and then the operation again returns to S6. On the other hand, if the time has elapsed thirty minutes or more, the process goes back to S2, and the discharging wires *7b* are cleaned by the electrode cleaning means in the same manner described above.

Figure 8:
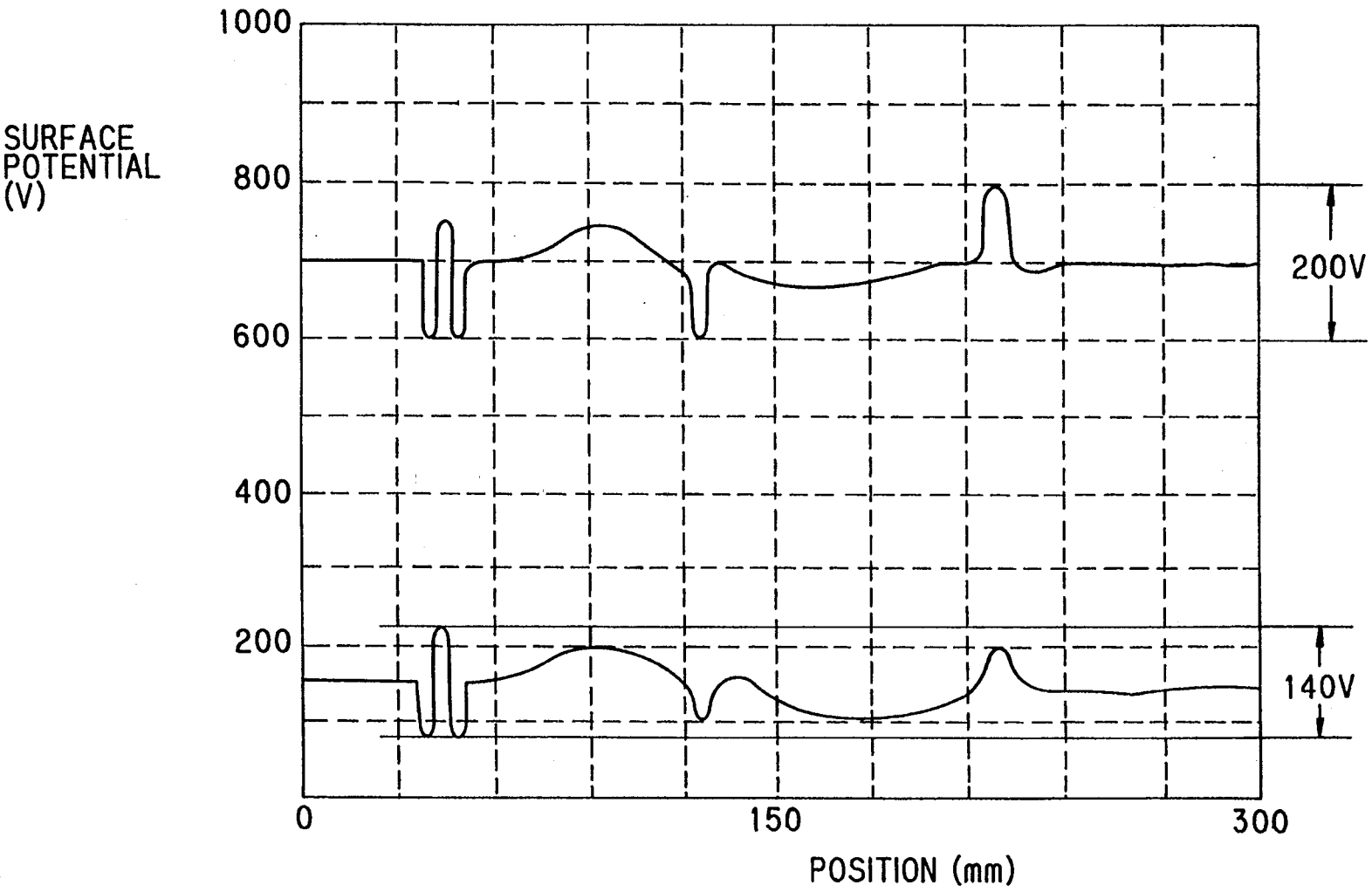
FIG. 8 is a graph showing variations of the surface potential on a photoconductive drum along the longitudinal direction thereof after a 50k-sheets practical aging operation.

A practical copying operation for 50k sheets of paper was made in the system for evaluating the aging behavior without operating the aforementioned electrode cleaning means. After the operation, measurement was made on the surface potential (or unevenness of the surface potential) in the longitudinal (or axial) direction of the photoconductive drum 1. FIG. 8 shows a graph of the result. In this graph, an upper curve shows a variation of the potential in the solid area, whereas a lower curve represents a variation of the potential in the blank area.

As is apparent from FIG. 8, the potential in the solid area varies within a range of 700±100 v and the potential in the blank area varies within a range of 150±70. "As may be seen both areas exhibit great unevenness in potential".

Figure 9:
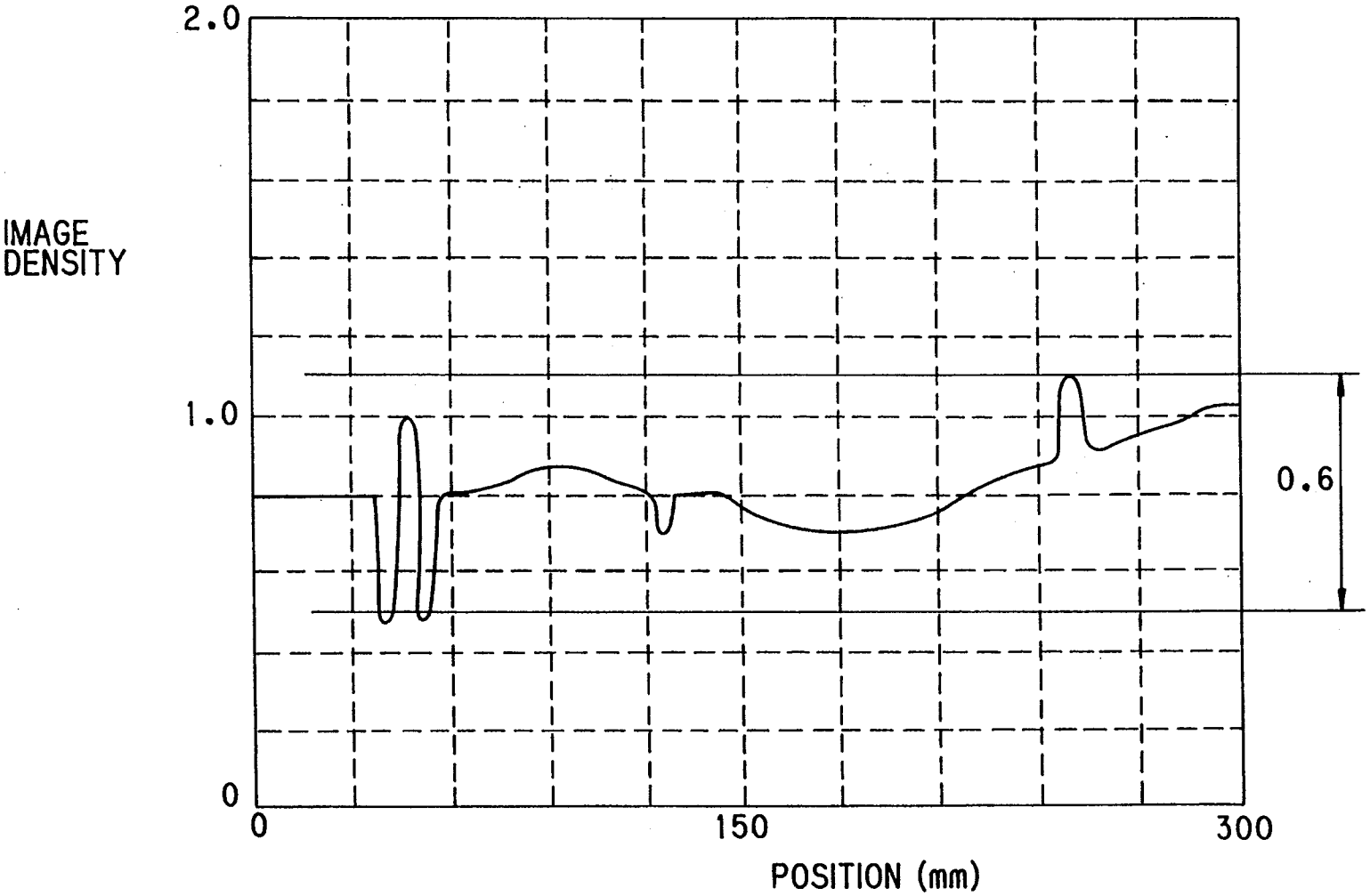
FIG. 9 is a graph showing variations of the image density on a photoconductive drum along the longitudinal direction thereof after a 50k-sheets practical aging operation.

In the same condition, an original M with a uniform halftone density (about 0.4 in the optical reflection density) was subjected to a copying operation, and the density (or the density unevenness) was evaluated in the longitudinal direction of the photoconductive drum 1. FIG. 9 shows a graph of the result. As will be appreciated from the result of FIG. 9, the density unevenness which can be attributed to the unevenness of the surface potential exhibits a markedly great unevenness, specifically a variation of 0.8±0.3 in reflection density.

In order to find the cause, the discharging wire *7b* was observed in its surface using an optical microscope and an electron microscope. As a result, needle-like formation was observed. From a qualitative composition analysis for the formation, a large amount of Si-element was detected, from which it was assumed that the needle-like formation was provably created by evaporation and splash of the silicon oil used in the heat-fixing step. It will be apparently understood that an erroneous process control must be made if such a portion with unevenness is detected as a reference by the surface potential sensor 22 and the optical sensor 23. Since the surface potential of the photoconductive drum 1 varies or fluctuates to a degree of 100 to 150 v, if the precision in detecting for the process to be regulated includes ±100 v due to the surface potential unevenness, the control itself will lose its meaning. The process control by means of the optical sensor 23 is also likely to be effected based upon information not representing a typical value for the photoconductive drum 1, in consequence the control itself not only becomes meaningless, but also gives rises to a fear of increasing the unstablity.

Figure 10:
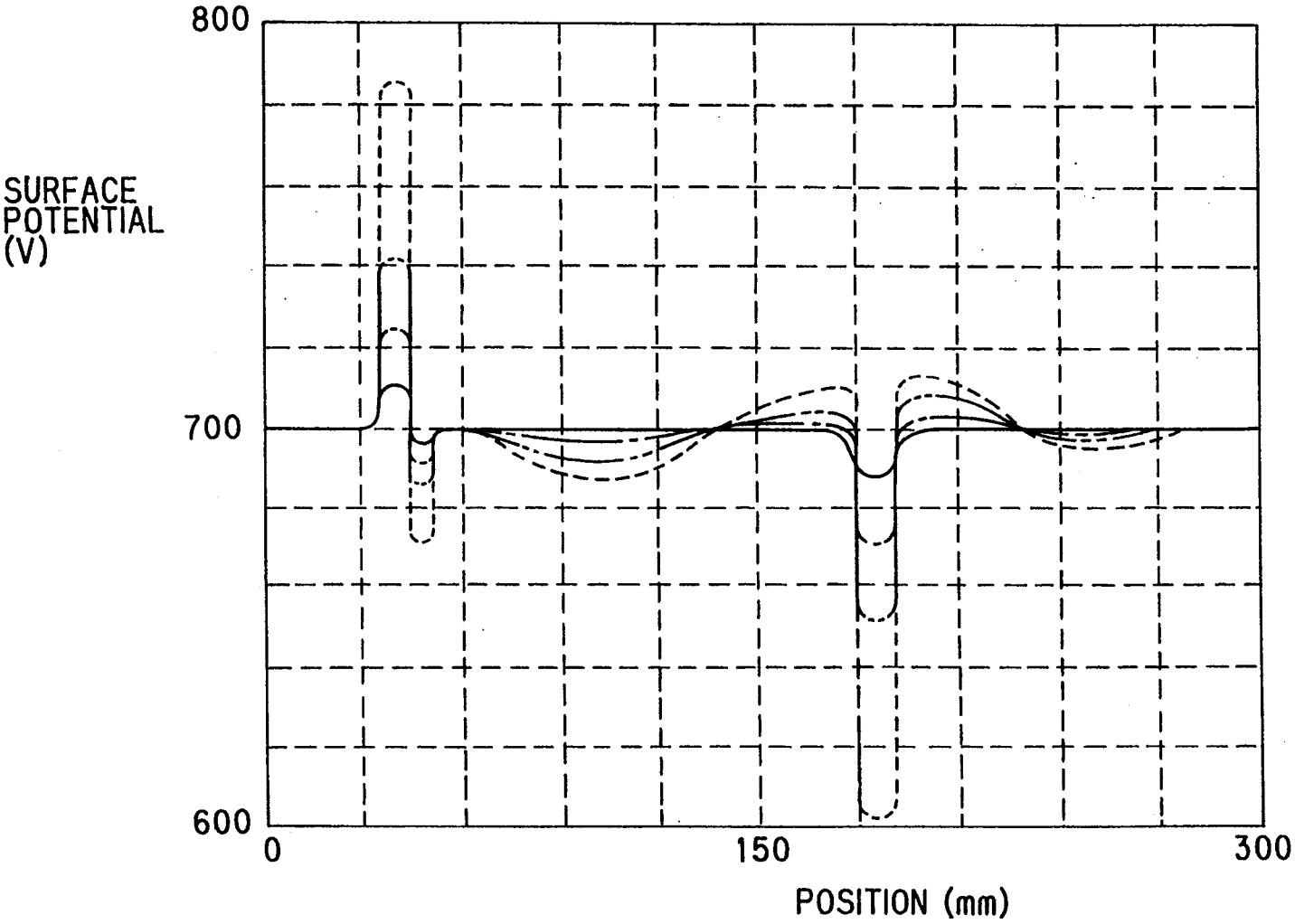
FIG. 10 is a graph showing variations of the surface potential on that photoconductive drum along the longitudinal direction thereof which has been subjected to a 50k-sheets practical aging operation and is charged by charging wires cleaned by electrode cleaning means.
Figure 11:
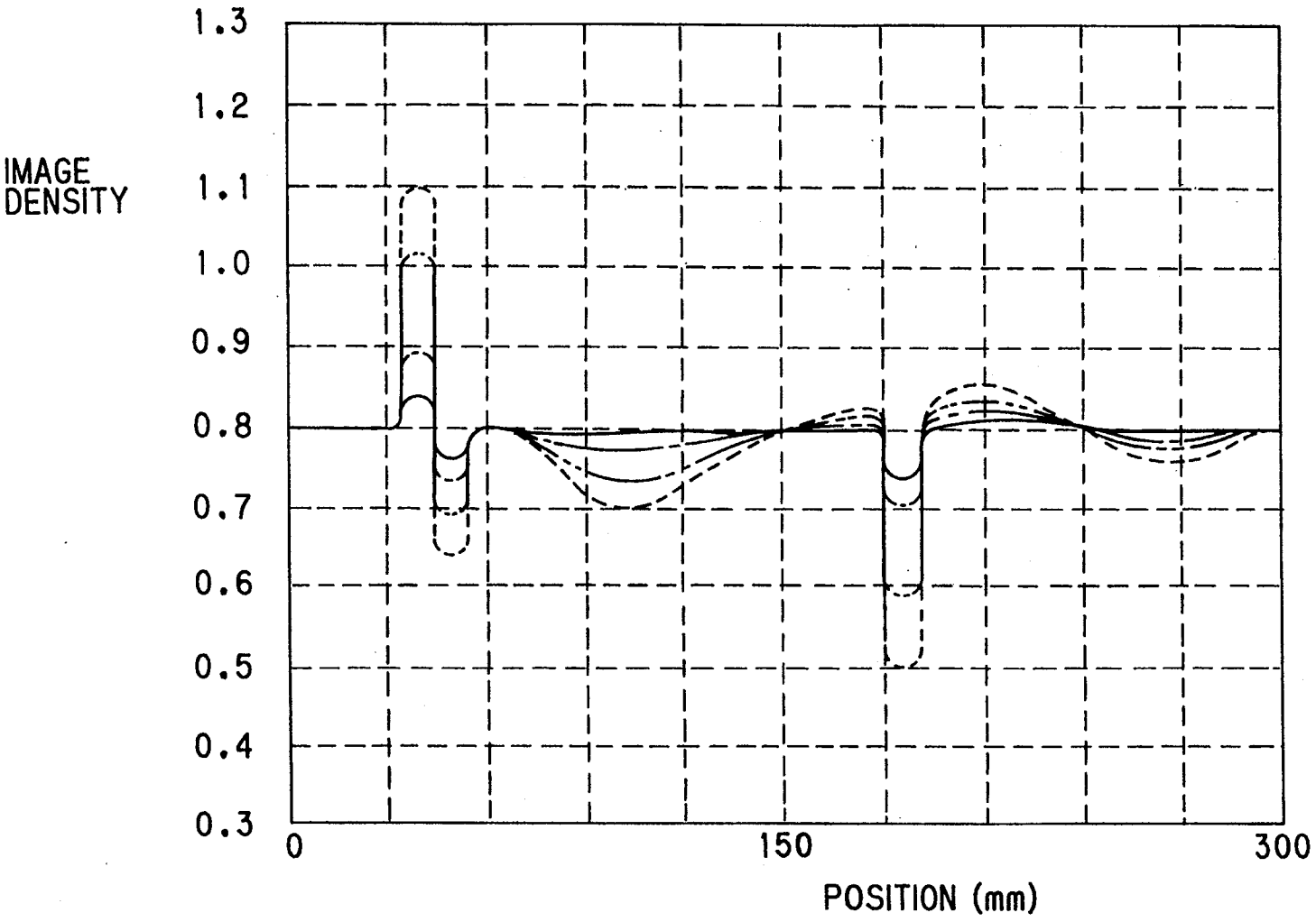
FIG. 11 is a graph showing variations of the image density on that photoconductive drum along the longitudinal direction thereof which has been subjected to a 50k-sheets practical aging operation and is charged by charging wires cleaned by electrode cleaning means.

Next, after another real copying operation for 50k sheets of paper in the system for evaluating the aging, evaluation was made of the unevenness of the surface potential and the unevenness of the halftone image density in the longitudinal direction of the photoconductive drum 1. Then, the discharging wires *7b* were cleaned by activating the electrode cleaning means, and the surface potential and the halftone image density were measured in this condition. FIGS. 10 and 11 show graphs of the result. Upon the measurement, the cleaning operation of the discharging wires *7b* was effected by slidably wiping the wires *7b* with the frictionally slidable piece 31 constituting the electrode cleaning means being traveled three rounds. The surface potential and the halftone image density were measured after each round of the frictionally slidable piece 31. In FIGS. 10 and 11, a dashed line represents result immediately after the practical copying operation for aging. A double-dots chain line indicates a result after the first round travel of the frictionally slidable piece 31. A single dot chain line and a solid line represent results after the second and third round travels, respectively.

As is clearly shown in FIGS. 10 and 11, the unevenness of the surface potential and the halftone image density is reduced by the operation of the electrode cleaning means. Specifically, after the three rounds operation of the frictionally slidable piece 31, the former reduces to a range of ±15 v, and the latter to a range of ±0.1 to present substantially eliminated unevenness. The detection of the surface potential by the surface potential sensor 22, or the detection of the reflection density by the optical sensor 23 in such a condition, can be considered as sufficiently representing a state of the photoconductive drum 1. Therefore, the process control performed based on the detection result can achieve the desired object, in particular, properly compensate or correct the fluctuation of the surface potential of the photoconductive drum 1 and the instability of the developer used.

As detailed heretofore, this process control stabilizing system 20 controls the photoelectrographic process by the CPU 21 with reference to the detection signals from the surface potential sensor 22 and the optical sensor 23. Additionally, the above CPU 21 activates the electrode cleaning means provided for the main charger unit 7 automatically to clean the discharging wires *7b* before the detection steps of the sensors 22, 23, so that a uniform discharge from the main charger unit 7 may be expected.

Consequently, the photoelectrographic process control is executed by the CPU 21 as described above, based on the proper information from the sensors 22, 23, thus making it possible to provide an optimum image to a copy paper sheet P in the copy operation.

Figure 12:
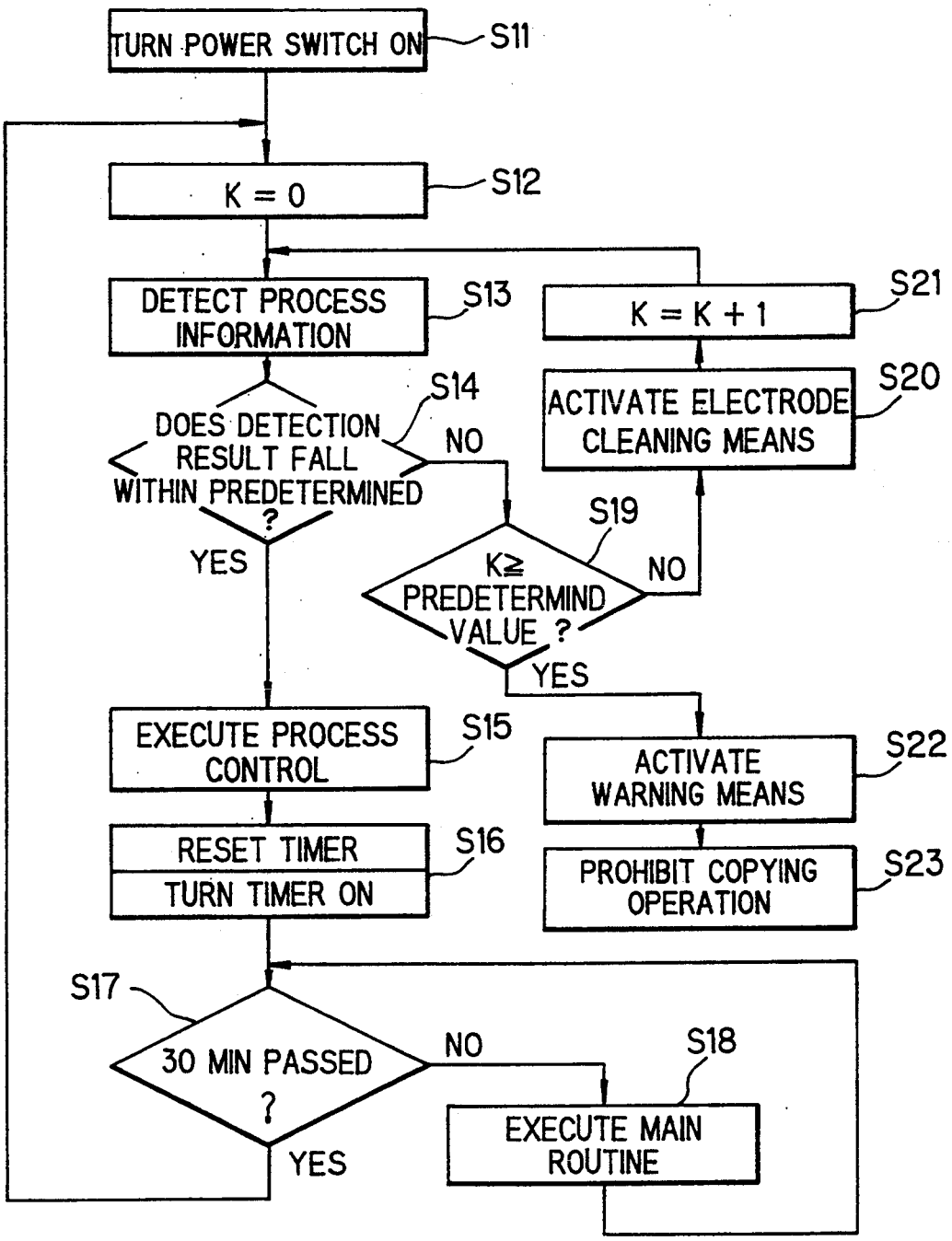
FIG. 12 is a flowchart illustrating operations for controlling the copying process executed by a CPU in another embodiment of the invention.

Referring next to FIG. 12, another embodiment of the present invention will be described hereinafter. In this embodiment, all the configurations are the same with those of the previous embodiment except the function of the CPU 21 as a part of the process control stabilizing system 20 of the previous embodiment.

Therefore, descriptions for other than the copying process control effected by a CPU will be abbreviated. Further, like reference numerals will be allotted for identical members having similar functions to those in the previous embodiment. The CPU used here is also designated by the same reference numeral 21 as in the previous embodiment for convenience (see FIG. 1).

The CPU 21 of this embodiment sends out output signals, based upon the surface potential sensor 22 and the optical sensor 23 in the similar manner to the previous embodiment, to the power sources 27, 28, 29 and the toner supply driving unit 30, to effect an optimum copying process control.

In the above optimum control in the copying process, the CPU 21 determines whether or not the measurement obtained from the sensors 22, 23 fall within predetermined ranges before the process control. If a detection value falls out of the range, the CPU 21 controls to activate the driving motor for the electrode cleaning means, which in turn drives the frictionally slidable piece 31 to slidably wipe the discharging wires *7b*. The series of the operations, that is, the above judgement on each of the detection results and the cleaning of the discharging wires *7b*, will be repeated in a predetermined number of times until the detection results fall within the predetermined ranges.

Even after the cleaning operations of the discharging wires *7b* have been repeated up to the predetermined number of times, if each of the detection results does not fall within the predetermined range, the CPU 21 activates an unillustrated warning means so as to inform the user that the apparatus is out of order. At the same time, the CPU 21 stops each of the constituents from functioning, to thereby prohibit the copying operation.

With the arrangement of the process control stabilizing system 20 described above, description will be made on a controlling operation of the electro-photographic process effected by the CPU 21 with reference to a flowchart shown in FIG. 12.

First, when the power switch of the copier is turned on (S11), the number K of operation times of the cleaning means is initialized, or set at zero (S12). Then the surface potential sensor 22 detects the surface potential of the photoconductive drum 1, while the optical sensor 23 detects the optical density of the reference toner image formed on the surface of the photoconductive drum 1. The thus detected signals are inputted to the CPU 21 through the respective amplifiers 25, 25 and the respective A/D converters 26, 26 (S13).

Next, judgement is made by the CPU as to whether or not the detected results from the sensors 22, 23 fall within predetermined ranges (S14).

At S14, if each detection result falls within the predetermined range, the CPU 21, based on the detected signals from the sensors 22, 23, sends out output signals to the power sources 27, 28, 29 and the toner supply driving device 30, so as to optimally control the voltage of the exposure lamp 4, the power of the main charger unit 7, the development bias voltage for the developing unit 9, and the toner density of the developer (S15). Then, a timer (not shown) in the system is reset or initialized and thereafter activated (S16). In a next step (S17), judgment is made on whether thirty minutes has elapsed after the timer was turned on. At S17, if the lapse of time is less than thirty minutes, the main routine is executed (S18), and then the operation again returns to S17. On the other hand, if the time elapsed is judged to be thirty minutes or more at S17, the process goes back to S12, and the number K of times when the electrode cleaning means was operated is reset at zero as described above.

On the other hand, if the detected results fall out of the predetermined ranges, judgement is made at S19 as to whether or not the number K of times when the electrode cleaning means was operated is equal to or larger than the predetermined value (number of times) at S19. When the number K of the operation times is judged at S19 as to be less than the predetermined value, namely, the electrode cleaning means has not yet operated the predetermined times, the CPU 21 controls the driving motor so as to move the frictionally slidable piece 31 back and forth three rounds in the direction $C_1$–$C_2$, thus wiping and cleaning the discharging wires *7b* in the main charger unit 7 (S20). Thereafter, the number K of the operation times is increased by one (S21), then the process goes back to S13 again.

When the number K of the operation times is not less than the predetermined value, or electrode cleaning means has operated the predetermined times, the CPU 21 activates the warning means to inform the user that the apparatus is out of order (S22). Then, each of the constituents are stopped from functioning, to prohibit the copying operation (S23).

Here, the criteria or the predetermined ranges based on which the CPU 21 judges as to the surface potential and the optical density, are not to be specified particularly, since the criteria are dependent upon the types of the photoconductive drum 1 and the developer used, environment in which the apparatus is used, and other factors. But in this embodiment, the surface potential is limited within $700 \pm 150$ v, and the optical density is limited within $0.8 \pm 0.4$, to obtain an appropriate operation result.

As detailed heretofore, in this process control stabilizing system 20, the CPU 21 determines whether or not each of the detection results from the sensors 22, 23 lies within the predetermined ranges, and if the detected results fall out of the ranges, the CPU controls the electrode cleaning means to cleans the discharging wires *7b* before the control of the copying process is executed. Further, if, despite that the CPU 21 has repeated the predetermined times the series of the operations described above, the detection results will not fall within the predetermined ranges, the CPU judges that something wrong happens in the apparatus. With this judgement, the CPU 21 activates the warning means and stops each of the constituents from functioning, to thereby inform the user that the apparatus is out of order, and to prohibits the copying operation.

Accordingly, based upon each of the detection results from the surface potential sensor 22 and the optical sensor 23, it is possible to clean the discharging wires *7b* effectively. In addition, the system automatically judges an abnormal or defective state of the apparatus, so that it is possible to obviate a serious accident.

Figure 13:
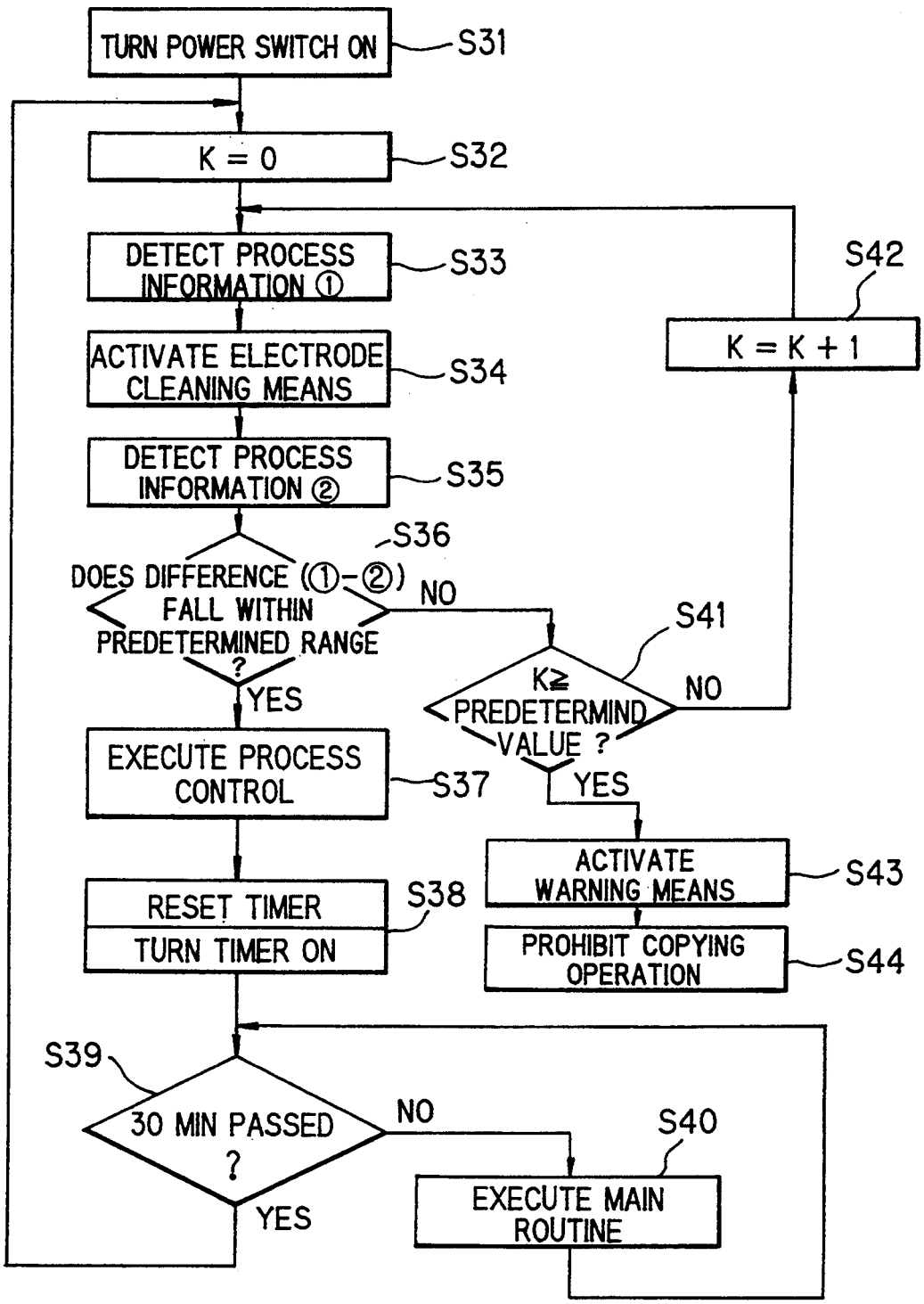
FIG. 13 is a flowchart illustrating operations for controlling the copying process executed by a CPU in still another embodiment of the invention.

Next, referring to FIG. 13, still another embodiment of the invention will hereinafter be described.

In this embodiment, all the configurations are the same with those of the first embodiment except the function of the CPU 21 as a part of the process control stabilizing system 20 of the first embodiment. Therefore, descriptions for other than the copying process control effected by a CPU will be abbreviated. Further, like reference numerals will be allotted for identical members having similar functions with those in the first embodiment. The CPU used here is also designated by the same reference numeral 21 as in the first embodiment for convenience (see FIG. 1).

The CPU 21 of this embodiment sends out output signals, based upon the surface potential sensor 22 and the optical sensor 23 in the similar manner to the first embodiment, to the power sources 27, 28, 29 and the toner supply driving unit 30, to effect an optimum copying process control.

In the above optimum control in the copying process, the CPU 21 executes the detections of the surface potential by the surface potential sensor 22 and the optical density by the optical sensor 23. Then, the CPU 21 activates and controls the driving motor constituting the electrode cleaning means so as to wipe and clean the discharging wires **7*b* by the frictionally slidable piece 31. Thereafter, the CPU 21 again executes the detections using the sensors 22, 23, and compares the detected values before a cleaning of the wires 7*b* with those after the cleaning, and finds respective differences for each detection item. The CPU 21** repeats the control up to a predetermined number of times until the differences fall within the predetermined ranges.

Even after the cleaning operations of the discharging wires **7*b* have been repeated the predetermined number of times, if each difference of the detection results does not fall within the predetermined range, the CPU 21 activates an unillustrated warning means so as to inform the user that the apparatus is out of order. At the same time, the CPU 21** stops each the constituents from functioning to thereby prohibit the copying operation.

With the arrangement of the process control stabilizing system 20 described above, description will be made on a controlling operation of the electro-photographic process effected by the CPU 21 with reference to a flowchart shown in FIG. 13.

First, when the power switch of the copier is turned on (S31), the number K of operation times of the cleaning means is initialized, or set at zero (S32). Then the surface potential sensor 22 detects the surface potential of the photoconductive drum 1, while the optical sensor 23 detects the optical density of the reference toner image formed on the surface of the photoconductive drum 1. The thus detected signals are inputted to the CPU 21 through the respective amplifiers 25, 25 and the respective A/D converters 26, 26 (S33). The thus detected process information will be referred to as ①.

The CPU 21 controls the driving motor so as to move the frictionally slidable piece 31 back and forth three rounds in the direction $C_1$–$C_2$, thus wiping and cleaning the discharging wires **7*b* in the main charger unit 7 (S34). Thereafter, the sensors 22, 23 again execute the detection operations of the surface potential and the optical density, respectively and the resultant signals are inputted into the CPU 21 (S35). The thus detected process information at S35** will be referred to as ②.

Next, differences are taken by subtracting the process information ② from the process information ①, and judgement is made as to whether or not the differences fall within predetermined ranges (S36).

At S36, if each of the differences between the process information ① and ② falls within the predetermined range, the CPU 21, based on the detected signals from the sensors 22, 23, sends out output signals to the power sources 27, 28, 29 and the toner supply driving device 30, so as to optimally control the voltage of the exposure lamp 4, the power of the main charger unit 7, the development bias voltage for the developing unit 9, and the toner density of the developer (S37). Then, a timer (not shown) in the system is reset or initialized and thereafter activated (S38). In a next step (S39), judgment is made on whether thirty minutes has elapsed after the timer was turned on. At S39, if the lapse of time is less than thirty minutes, the main routine is executed (S40), and then the operation returns to S39 again. On the other hand, if the time elapsed is judged to be thirty minutes or more at S39, the process goes back to S32 again, and the number K of times when the electrode cleaning means was operated is reset at zero as described above.

On the other hand, if each of the differences between the process information ① and ② falls out of the predetermined range at S36, judgement is made at S41 as to whether or not the number K of times when the electrode cleaning means was operated is equal to or larger than the predetermined value (number of times). When the number K of the operation times is judged at S41 as to be less than the predetermined value, namely, the number of the operations of the electrode cleaning means does not reach the predetermined number of times, the number K of the operation times is increased by one (S42), then the process goes back to S33 again. When the number K of the operation times is not less than the predetermined value, or the electrode cleaning means has operated the predetermined number of times, the CPU 21 activates the warning means to inform the user that the apparatus is out of order (S43). Then, each of the constituents are stopped from functioning to prohibit the copying operation (S44).

Here, the ranges within which the differences between the process information ① and ② are limited by the CPU 21 are not to be specified particularly, but in this embodiment, the difference of the surface potential between the information ① and ② is limited within 15 v, while the difference of the optical density is limited within 0.05 to 0.08, to obtain an appropriate operation result.

As detailed heretofore, in this process control stabilizing system 20, the first and second sampling of the process control information, or the first and second detections of the surface potential by the sensor 22 and the optical image density by the sensor 23, are executed before and after the cleaning operation of the wire **7*b*. Then based upon the detected result, the CPU 21 determines whether or not each of the differences of the first and second process control information from the sensors 22, 23 lies within the predetermined ranges, and if the differences fall out of the ranges, the CPU controls the electrode cleaning means to clean the discharging wires 7*b* before the control of the copying process is executed. Further, if, despite that the CPU 21 has repeated the predetermined times the series of the operations described above, the differences will not fall within the predetermined ranges, the CPU judges that something wrong happens in the apparatus. With this judgement, the CPU 21** activates the warning means and stops each of the constituents from functioning, to thereby inform the user that the apparatus is out of order, and to prohibits the copying operation.

Accordingly, the system of this embodiment can detect the unevenness of charging by the main charger unit 7 with an increased exactness, and assures to remove adverse influences of the disturbances and noises caused by the charging unevenness. In addition, the system can effect an exact detection of the charging unevenness as stated above, so that it is possible to make a sever decision about the abnormality of the apparatus.

The present invention is not limited to the three embodiment presented heretofore, but various changes and modification can be made within the scope of the invention. For example, in the second and third embodiments, the frictionally slidable piece 31 for cleaning the discharging wire *7b* is moved back and forth three rounds with respect to the discharging wires *7b*, but the number of times for wiping is not in particular limited. The parts and constituents of the surface sensor 22 or the optical sensor 23 which constitutes the process control stabilizing system 20 are not specified. The control of the exposure lamp 4, main charger unit 7 and developing unit 9 accompanied with the system is not limited by the embodiments, either.

Moreover, in the second and third embodiment, if the detection results or the difference of the detected results fall out of the predetermined ranges after the predetermined number of times of cleaning the discharging wires *7b*, the system is constructed such as to both activate the warning means and prohibit the copying operation. But it is not necessary to effect both the operations, provision of either one alone will still work.

As is apparent from these embodiments, the process control stabilizing system of the invention includes various novel features which have not been realized before, so that the system of the present invention can achieve excellent effects as follows.

In accordance of one aspect of the present invention, the system is constructed such that the charger is provided with electrode cleaning means for cleaning the discharging electrode, and the process control means controls and activates the electrode cleaning means to clean the discharging electrode of the charger prior to detection of the surface potential of the photoconductive member by the potential detecting means. With this construction, the surface potential can be detected by the potential detecting means with the discharge from the charger kept assuredly uniform, in consequence, it is possible to effect an optimum process control based on the exact information.

In accordance with another aspect of the present invention, the system is constructed such that the charger is provided with electrode cleaning means for cleaning the discharging electrode, and the process control means controls and activates the electrode cleaning means to clean the discharging electrode of the charger prior to detection of the optical density by the density detecting means. With this construction, the surface potential can be detected by the potential detecting means with the discharge from the charger kept assuredly uniform, in consequence, it is possible to effect an optimum process control based on the exact information.

In accordance with further aspect of the present invention, the system is constructed such that the charger is provided with electrode cleaning means for cleaning the discharging electrode, and the process control means controls and activates the electrode cleaning means to clean the discharging electrode of the charger if the detection result from the potential detecting means and/or the density detecting means falls out of a predetermined range, performs again the detection to obtain detection result from the potential detecting means and/or the density detecting means, and repeats the series of controlling operations until the detection result falls within the predetermined range. With this arrangement, the cleaning of the discharge electrode of the charger can be effectively carried out based on the detection result from the potential detecting means and/or the density detecting means, in consequence, it is possible to assuredly eliminate cause for the charging unevenness brought about by the charger, thus making it to effect an optimum process control based on more exact information.

In the above process control stabilizing system, the process control means is constructed such that, in a case where the operation of the electrode cleaning means based on the detection result from the potential detecting means and/or density detecting means has been repeated up to a predetermined number of times, if the detection result after the predetermined times of detections does not fall within the predetermined range, the system activates warning means and/or prohibits copying operation. With this construction, an abnormal or defective state in the apparatus can be automatically recognized, so that it is possible to prevent a serious accident from occurring.

In accordance with still another aspect of the invention, the system is constructed such that the charger is provided with electrode cleaning means for cleaning the discharging electrode, and the process control means controls and activates the electrode cleaning means to clean the discharging electrode of the charger after the detection step in which the surface potential is detected by the potential detecting means and/or the optical density is detected by the density detecting means, thereafter performs again the detection to obtain detection result from the potential detecting means and/or the density detecting means, takes a difference of the detection result between before and after the cleaning of the discharging electrode, and repeats the series of controlling operations until the difference of the detection result falls within a predetermined range. With this construction, it is possible to detect the charging unevenness caused by the charger exactly, and to assuredly eliminate the influence of disturbances and noises caused by the charging unevenness. In consequence, it is possible to assuredly eliminate the cause of the charging unevenness brought about by the charger, thus making it possible to effect an optimum process control based on more exact information.

In the above process control stabilizing system, the process control means is constructed such that, in a case where the operation of the electrode cleaning means based on the difference of the detection result from the potential detecting means and/or density detecting means has been repeated up to a predetermined number of times in the process control means, if the difference of the detection result after the predetermined times of the detections does not fall within the predetermined range, the system activates warning means and/or prohibits copying operation. With this arrangement, an abnormal or defective state in the apparatus can be recognized more severely, so that it is possible to assuringly prevent an accident from occurring.

What is claimed is:

1. A stabilizing system for use in an image forming apparatus in which a visual image is formed by the steps of electrifying the surface of a photoconductive member by discharging electricity from a discharging electrode of a charger, exposing the photocoductive member to light corresponding to a pattern image to form an electrostatic latent image, and developing the latent image with toner, said system which comprises at least one or both of potential detecting means for detecting the surface potential of the photoconductive member and density detecting means for detecting the optical density of a toner image and providing a detection result and allows a process control means to control the electrophotographic process on the basis of the detection result to thereby obtain an optimum image, characterized in that said charger is provided with an electrode cleaning means for cleaning the discharging electrode; and said process control means controls and activates the electrode cleaning means to clean the discharging electrode of the charger if the detection result provided from the potential detecting means and/or the density detecting means falls out of a predetermined range, performs again the detection to obtain the present detection result from the potential detecting means and/or the density detecting means, and repeats its operation until the present detection result from the potential detecting means and/or the density detecting means falls within the predetermined range.

2. A stabilizing system according to claim 1, wherein in case where operation of the electrode cleaning means based on the detection result from said potential detecting means and/or density detecting means has been repeated up to a predetermined number of times in said process control means, if the detection result after the predetermined times of detections does not fall within the predetermined range, said system activates warning means and/or prohibits copying operation.

3. A stabilizing system for use in an image forming apparatus in which a visual image is formed by the steps of electrifying the surface of a photoconductive member by discharging electricity from a discharging electrode of a charger, exposing the photoconductive member to light corresponding to a pattern image to form an electrostatic latent image, and develop on the latent image with toner, said system which comprises at least one or both of potential detecting means for detecting the surface potential of the photoconductive member and density detecting means for detecting the optical density of a toner image and providing a detection result and allows a process control means to control the electrophotographic process on the basis of the detection result to hereby obtain an optimum image, characterized in that said charger is provided with an electrode cleaning means for cleaning the discharging electrode; and said process control means controls and activates the electrode cleaning means to clean the discharging electrode of the charger after the detection step in which the surface potential is detected by the potential detecting means and/or the optical density is detected by the density detecting means, and thereafter performs again the detection to obtain detection result from the potential detecting means and/or the density detecting means takes a difference of the detection result between before and after the cleaning of the discharging electrode, and repeats its operation until the difference of the present detection result falls within a predetermined range.

4. A stabilizing system according to claim 3, wherein in a case were operation of the electrode cleaning means based on the difference of the detection result from said potential detecting means and/or density detecting means has been repeated up to a predetermined number of times in said process control means, if the difference of the detection result after the predetermined times of the detections does not fall within the predetermined range, said system activates warning means and/or prohibits the copying operation.

* * * * *